US006754931B2

(12) United States Patent
Chen

(10) Patent No.: US 6,754,931 B2
(45) Date of Patent: Jun. 29, 2004

(54) BATHING BRUSH

(76) Inventor: Ching-Chen Chen, No. 80-2, Wung-Yuann Rd., Pei-Dou Cheng, Chang-Hau Hsien (TW)

( * ) Notice: Subject to any disclaimer, the term of this patent is extended or adjusted under 35 U.S.C. 154(b) by 130 days.

(21) Appl. No.: 10/066,612

(22) Filed: Feb. 6, 2002

(65) Prior Publication Data

US 2003/0145407 A1 Aug. 7, 2003

(51) Int. Cl.[7] ..... A47L 13/10; A47L 17/08; A47L 13/46; A47K 7/02

(52) U.S. Cl. ..... 15/229.11; 15/229.12; 15/229.13; 15/209.1

(58) Field of Search ..... 15/229.11, 229.12, 15/229.13, 209.1, 210.1, 222, 244.1; 300/21; D32/40; D28/63

(56) References Cited

U.S. PATENT DOCUMENTS 1,851,237 A * 3/1932 Bradford ..... 15/229.11
5,727,277 A * 3/1998 Chien ..... 15/209.1
6,098,236 A 8/2000 Chen ..... 15/222
6,112,363 A * 9/2000 Chen ..... 15/222
6,131,234 A * 10/2000 Chen ..... 15/229.11
6,161,246 A * 12/2000 Trachtenberg ..... 15/229.13

* cited by examiner

*Primary Examiner*—Robert J. Warden, Sr.
*Assistant Examiner*—Laura C. Cole
(74) *Attorney, Agent, or Firm*—Dennison, Schultz, Dougherty & MacDonald

(57) ABSTRACT

Bathing brush including an annular main body made of elastic and water-absorbent material and several bathing balls fixed on the main body at intervals. Each of the bathing balls includes at least one elastic mesh tube and at least one binding member. The circumference of the elastic mesh tube is crimped and waved. Then the elastic mesh tube is bound by the binding member. The bathing balls tightly abut against the circumference of the main body. In use of the bathing brush, the multiple bathing balls are able to maintain water therein. Moreover, the main body can also maintain a certain amount of water therein. The water contained in the main body can be gradually released to infiltrate into the adjacent bathing balls. Accordingly, the bathing balls can kept wet for a longer time.

4 Claims, 4 Drawing Sheets

BATHING BRUSH

BACKGROUND OF THE INVENTION

The present invention is related to a cleaning tool for cleaning human body, and more particularly to a bathing brush capable of maintaining water.

U.S. Pat. No. 6,131,234 discloses a cleaning brush for cleaning human body. The cleaning brush is made of a plastic elastic mesh tube with a certain length. A first, a second and a third binding members are bound on the mesh tube to form a first and a second expansion sections. Such cleaning brush is characterized in that the first expansion section is pumpkin-shaped and has relatively regular outer periphery. The second expansion section is petal-shaped and has irregular outer periphery. The pumpkin-shaped first expansion section is easy for a user to hold. The petal-shaped second expansion section has meshes extending in different directions for enhancing cleaning effect for human skin.

The above cleaning brush has small volume and can only contact with human skin on small area. Moreover, it is hard to use such cleaning brush to clean the back of a user. To overcome this problem, U.S. Pat. No. 6,098,232 discloses an elongated bar-like cleaning brush on which multiple bathing balls are sequentially arranged. A user can hold either end of the cleaning brush to clean his/her back.

Both the above two cleaning brushes employ elastic mesh tubes for brushing human skin and achieve satisfactory cleaning effect. However, the cleaning brushes are made of plastic material so that they can hardly maintain water therein during bathing. As a result, a user must frequently sprinkle water onto the cleaning brushes to kept them wet.

By means of increasing the length or diameter of the elastic mesh tube, the water maintained in the above cleaning brush can be slightly increased. However, the central portion of the cleaning brush, which is bound by the binding member and is quite hard will be enlarged. This makes it uneasy for a user to hold the cleaning brush. Moreover, when contacting with human skin, the user will feel uncomfortable.

SUMMARY OF THE INVENTION

It is therefore a primary object of the present invention to provide a bathing brush which not only is able to maintain therein more water than a conventional bathing brush, but also is able to prevent a user from feeling uncomfortable when using the bathing brush.

It is a further object of the present invention to provide the above bathing brush which contacts with human skin by larger area when used.

It is still a further object of the present invention to provide the above bathing brush which includes multiple bathing balls with different patterns so as to enhance the cleaning effect.

According to the above objects, the bathing brush of the present invention includes an annular main body made of elastic and water-absorbent material and several bathing balls fixed on the main body at intervals. Each of the bathing balls includes at least one elastic mesh tube and at least one binding member. The circumference of the elastic mesh tube is crimped and waved. Then the elastic mesh tube is bound by the binding member. The bathing balls tightly abut against the circumference of the main body. In use of the bathing brush, the multiple bathing balls are able to maintain water therein. Moreover, the main body can also maintain a certain amount of water therein. The water contained in the main body can be gradually released to infiltrate into the adjacent bathing balls. Accordingly, the bathing balls can kept wet for a longer time.

The present invention can be best understood through the following description and accompanying drawings wherein:

DETAILED DESCRIPTION OF THE PREFERRED EMBODIMENTS

Figure 2:
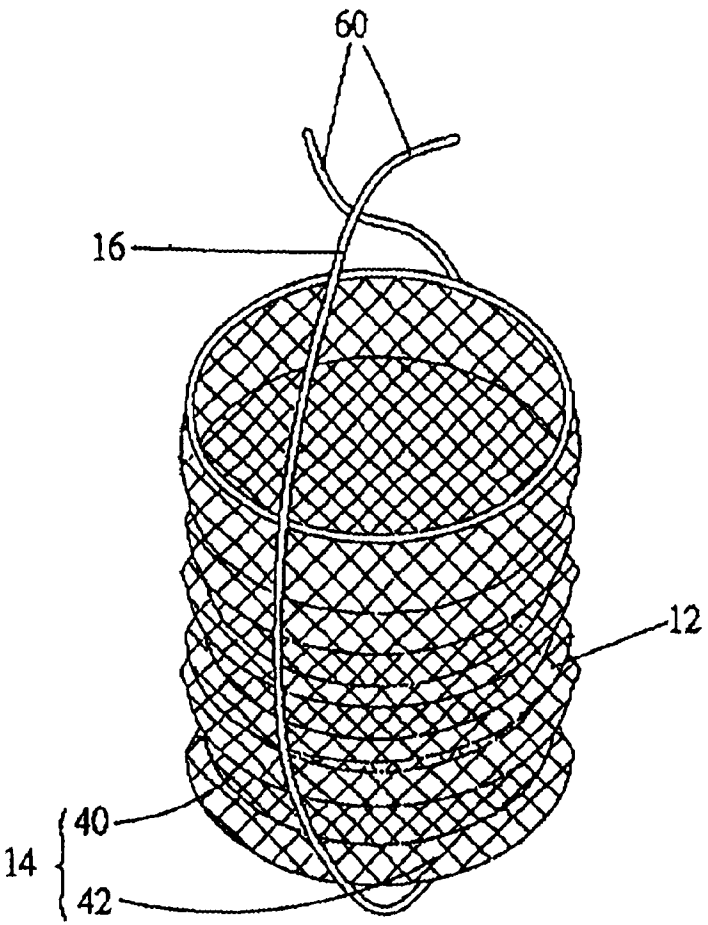
FIG. 2 is a perspective exploded view of the bathing ball of the first embodiment of the present invention.
Figure 1:
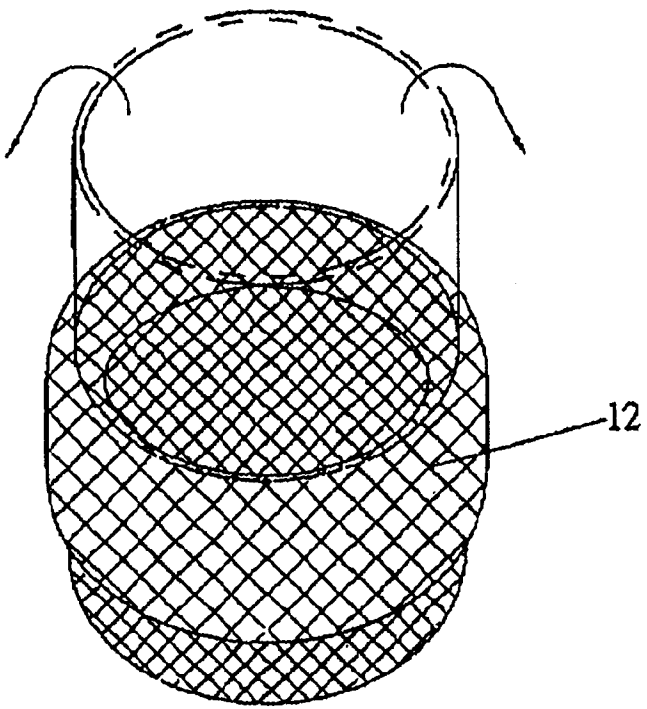
FIG. 1 is a perspective exploded view of the main body of a first embodiment of the present invention.
Figure 3:
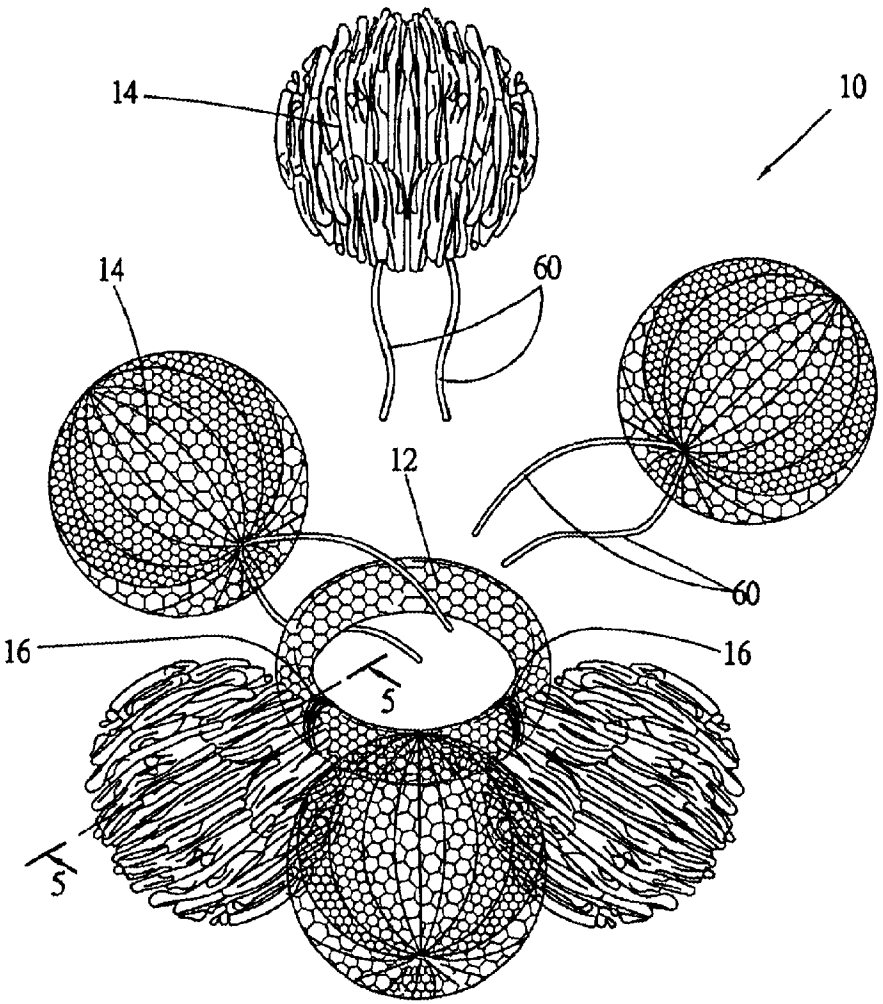
FIG. 3 is a perspective exploded view of the first embodiment of the present invention.
Figure 4:
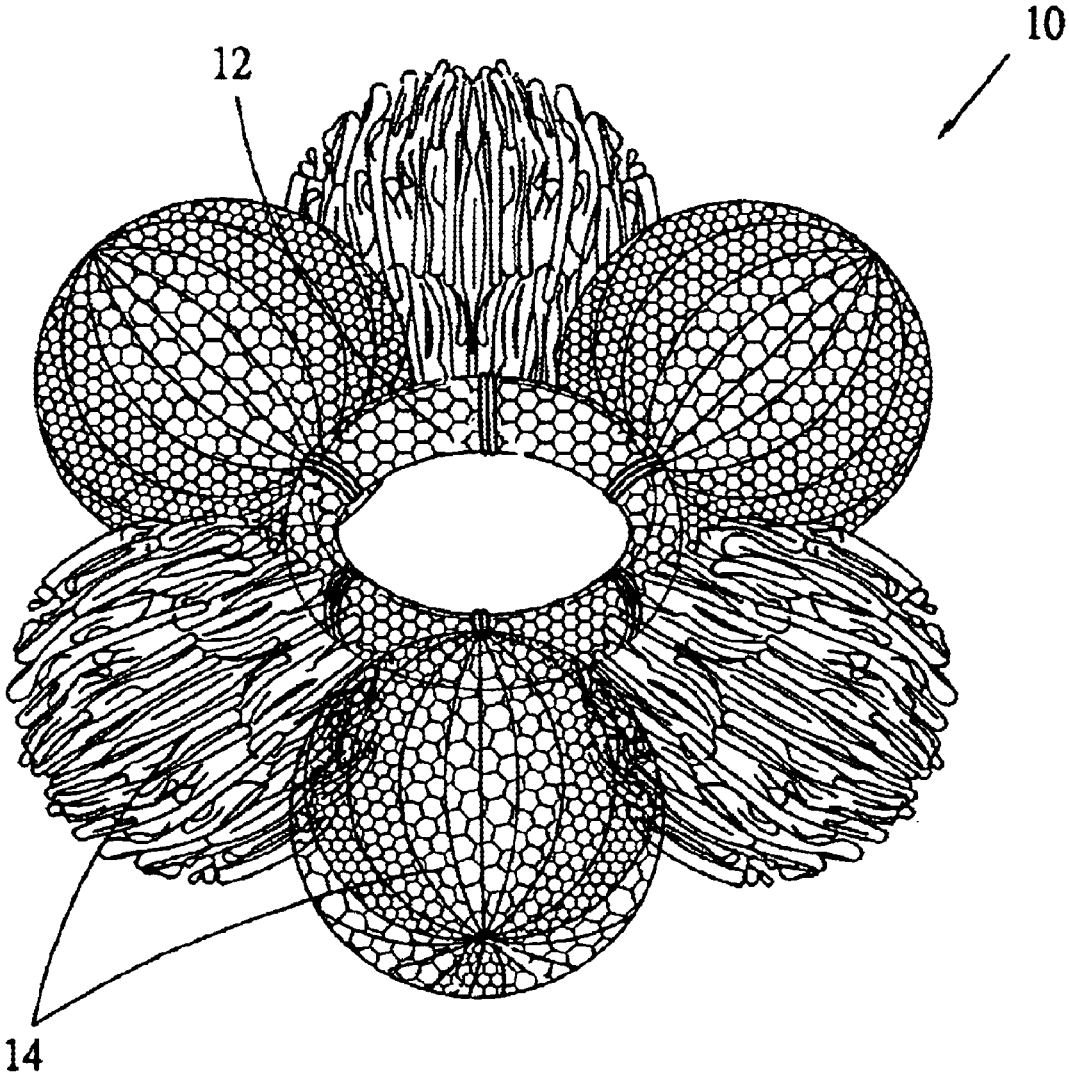
FIG. 4 is a perspective assembled view of the first embodiment of the present invention.
Figure 5:
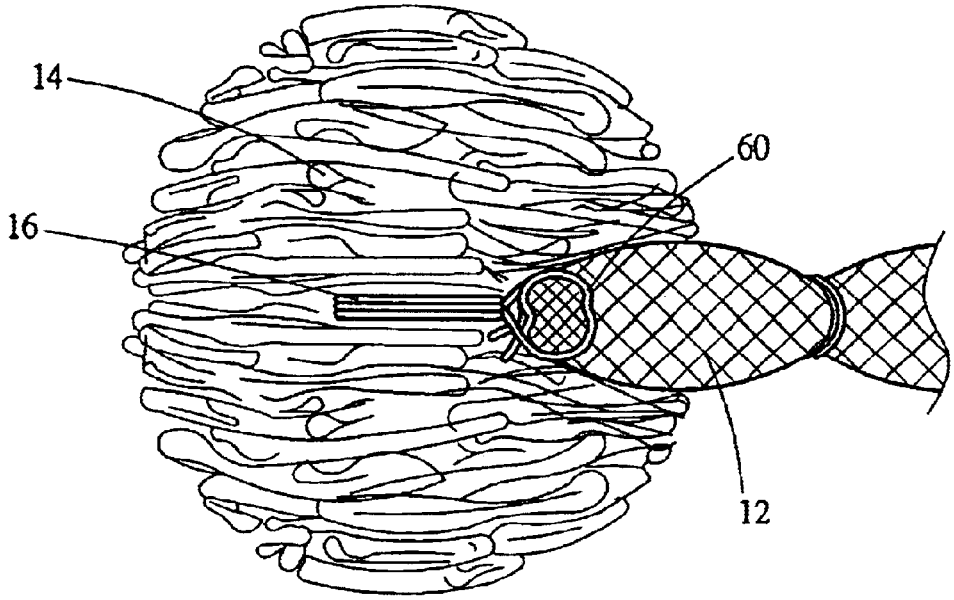
FIG. 5 is a sectional view taken along line 5—5 of FIG. 3.

Please refer to FIGS. 1 to 5. The bathing brush 10 of the present invention includes a main body 12 and six bathing balls 14 fixed on the circumference of the main body 12.

The main body 12 is made of an elastic mesh tube having numerous meshes with a certain size. The mesh tube is repeatedly continuously folded along the axis thereof to form a ring pattern.

Each bathing ball 14 is made of an elastic mesh tube having numerous meshes with a certain size. The circumference of each mesh tube is crimped and waved along the axis thereof. A binding member 16 such as a cotton thread is then wound around the mesh tube to bind the same. After bound, the mesh tube is divided by the binding member 16 into two halves which are respectively expanded to form two semispherical bodies 40, 42. The two semispherical bodies 40, 42 are combined to form the bathing ball 14. In this embodiment, there are three pumpkin-shaped bathing balls 14 and three petal-shaped bathing balls 14. By means of different directions of the meshes, a better cleaning effect can be achieved.

When assembled, the middle section of the binding member 16 is tied on each bathing ball 14. Two free ends 60 of each binding member 16 extend out by a predetermined length. Then, by means of the free ends 60 of the binding member 16, the bathing balls 14 are bound on the main body 12 at equal intervals. The circumferences of the bathing balls 14 tightly contact with the expanded circumference of the main body 12.

In use of the bathing brush 10, the multiple bathing balls 14 are able to maintain more water. Moreover, the main body 12 which is at the center and surrounded by the bathing balls 14 can also maintain a certain amount of water therein. Furthermore, in using state, the main body 12 is not directly compressed against human body. Therefore, the water contained therein can gradually infiltrate into the adjacent bathing balls 14 at a slow rate. Accordingly, the bathing balls 14 can kept wet for a long time. As a result, when wiping a user's skin, the bathing balls 14 make the user feel comfortable and achieved enhanced cleaning effect.

Figure 6:
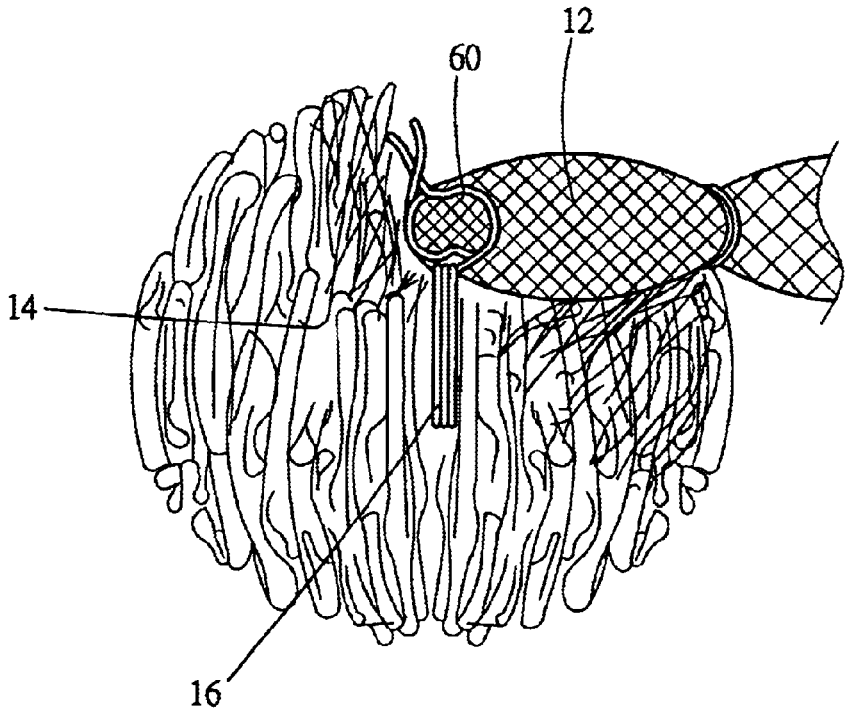
FIG. 6 is a sectional view of a second embodiment of the present invention.

In the above embodiment, the bathing balls 14 are adjacent to the outer circumference of the main body 12 which is hidden at the center of annularly arranged bathing balls 14. FIG. 6 shows another embodiment of the present invention, in which the main body 12 is adjacent to upper sides of the bathing balls 14.

In the above embodiments, each of the main body 12 and the bathing balls 14 is made of single elastic mesh tube. However, in actual application, each of them can be made of two or more elastic mesh tubes. One mesh tube can be nested in the other and overlapped thereon. Alternatively, the mesh tubes can be serially connected so as to enhance the water-maintaining effect. Also, by means of different sizes of meshes, the bathing ball 14 can have more irregular surface to achieve better cleaning effect. The bathing ball can be composed of various mesh tubes with different colors, whereby the bathing brush can have better appearance.

The above embodiments are only used to illustrate the present invention, not intended to limit the scope thereof. Many modifications of the above embodiments can be made without departing from the spirit of the present invention.

What is claimed is:

1. Bathing brush comprising:

an annular main body made of elastic and water-absorbent material; and several bathing balls fixed on the main body at intervals, each of the bathing balls including at least one elastic mesh tube and at least one binding member, the circumference of the elastic mesh being crimped and waved, then the elastic mesh tube being bound by the binding member, the bathing balls tightly abutting against the circumference of the main body, wherein the binding member is strip-like with a middle section of the building member being tied on the bathing ball and free ends of the binding member extending outward and being tied on the main body.

2. Bathing brush comprising:

an annular main body made of elastic and water-absorbent material; and several bathing balls fixed on the main body at intervals, each of the bathing balls including at least one elastic mesh tube and at least one binding member, the circumference of the elastic mesh being crimped and waved, then the elastic mesh tube being bound by the binding member, the bathing balls tightly abutting against the circumference of the main body, wherein the binding member is tied around the bathing ball to divide the bathing ball into two expanded semispherical bodies.

3. Bathing brush comprising:

an annular main body made of elastic and water-absorbent material; and several bathing balls fixed on the main body at intervals, each of the bathing balls including at least one elastic mesh tube and at least one binding member, the circumference of the elastic mesh being crimped and waved, then the elastic mesh tube being bound by the binding member, the bathing balls tightly abutting against the circumference of the main body, wherein the main body is positioned on inner sides of the annularly arranged bathing balls.

4. Bathing Bush as claimed is claim 3, wherein the main body is positioned on upper sides of the annularly arranged bathing balls.

* * * * *